US008205288B2

(12) United States Patent
Broman et al.

(10) Patent No.: US 8,205,288 B2
(45) Date of Patent: Jun. 26, 2012

(54) CLEANING DEVICE

(76) Inventors: Daniel Broman, Huddinge (SE); Mattias Mikaelsson, Sundbyberg (SE)

( * ) Notice: Subject to any disclaimer, the term of this patent is extended or adjusted under 35 U.S.C. 154(b) by 113 days.

(21) Appl. No.: 12/093,640

(22) PCT Filed: Sep. 11, 2007

(86) PCT No.: PCT/SE2007/000791

§ 371 (c)(1),
(2), (4) Date: Jul. 11, 2008

(87) PCT Pub. No.: WO2008/054278

PCT Pub. Date: May 8, 2008

(65) Prior Publication Data

US 2009/0217475 A1 Sep. 3, 2009

(30) Foreign Application Priority Data

Nov. 2, 2006 (SE) ..... 0602344

(51) Int. Cl.
*A47L 13/12* (2006.01)
*A47L 13/20* (2006.01)

(52) U.S. Cl. ..... 15/118; 15/209.1; 15/210.1; 15/228

(58) Field of Classification Search ..... 15/118, 15/209.1, 210.1, 228
See application file for complete search history.

(56) References Cited

U.S. PATENT DOCUMENTS

| | | | | |
|---|---|---|---|---|
| 1,973,984 | A * | 9/1934 | Hondeville | 15/208 |
| 4,335,731 | A * | 6/1982 | Bora, Jr. | 433/216 |
| 5,026,362 | A * | 6/1991 | Willett | 604/345 |
| 5,147,703 | A | 9/1992 | Provost et al. | |
| 5,331,705 | A | 7/1994 | Melov | |
| 5,372,575 | A * | 12/1994 | Sebastian | 602/20 |
| 5,530,984 | A * | 7/1996 | Walker | 15/209.1 |
| 5,761,761 | A | 6/1998 | An | |
| 5,878,439 | A * | 3/1999 | Waters, Jr. | 2/161.6 |
| 6,115,872 | A | 9/2000 | Welsh | |
| 6,210,778 | B1 | 4/2001 | Poirier et al. | |
| 6,256,840 | B1 | 7/2001 | Elliott | |
| 6,460,190 | B1 | 10/2002 | Blum | |
| 7,498,277 | B2 * | 3/2009 | Pace et al. | 442/69 |
| 2003/0124935 | A1 | 7/2003 | Smith et al. | |
| 2005/0034255 | A1 * | 2/2005 | Svendsen | 15/104.93 |
| 2005/0204501 | A1 * | 9/2005 | Golec | 15/209.1 |
| 2005/0283931 | A1 | 12/2005 | Endo et al. | |

(Continued)

FOREIGN PATENT DOCUMENTS

DE 29601221 3/1996

(Continued)

OTHER PUBLICATIONS

Supplementary European Search Report for Application No. EP 07 80 8805 dated Dec. 12, 2008.

International Search Report for PCT/SE2007/000791, (Feb. 2008).

*Primary Examiner* — Randall Chin

(74) *Attorney, Agent, or Firm* — Myers Bigel Sibley & Sajovec

(57) ABSTRACT

A cleaning device includes at least one cleaning cloth of one type of material providing a wiping function and a care label attached to an edge of the cleaning cloth. The label comprises a patch of a material of a type that has a different internal configuration than the material of the cleaning cloth and that provides a scrubbing function.

12 Claims, 2 Drawing Sheets

U.S. PATENT DOCUMENTS

| | | | | |
|---|---|---|---|---|
| 2006/0005335 | A1 | 1/2006 | Ortega et al. | |
| 2006/0075589 | A1 | 4/2006 | Choi | |
| 2007/0044263 | A1* | 3/2007 | Deng | 15/244.3 |
| 2007/0226934 | A1* | 10/2007 | Bohannon et al. | 15/209.1 |
| 2007/0256261 | A1* | 11/2007 | Benitez et al. | 15/118 |
| 2007/0299489 | A1* | 12/2007 | Francis et al. | 607/108 |

FOREIGN PATENT DOCUMENTS

| | | |
|---|---|---|
| DE | 2002006013078 | 12/2006 |
| JP | 2007-082731 | 4/2007 |
| WO | WO 03/092464 | 11/2003 |
| WO | WO 2004/096003 | 11/2004 |
| WO | WO 2005/044552 | 5/2005 |

* cited by examiner

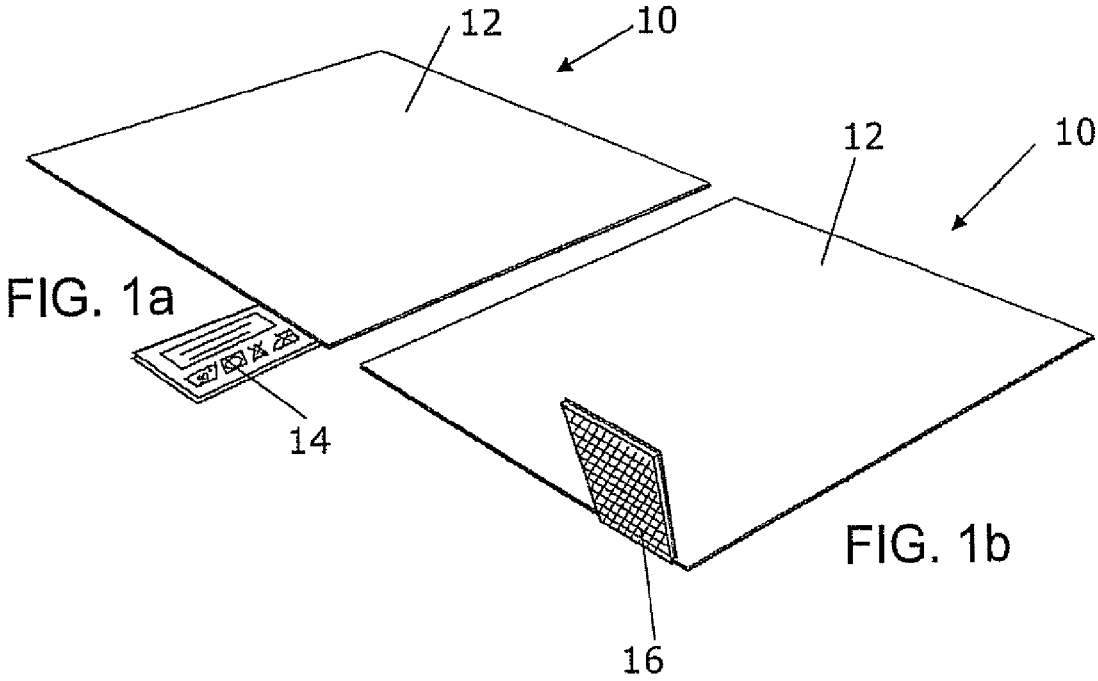
FIG. 1a
FIG. 1b
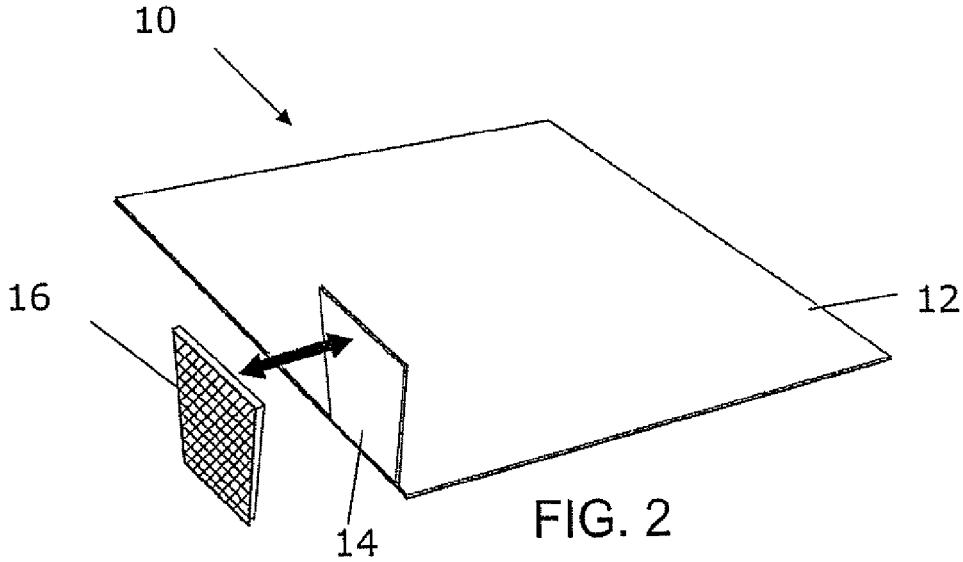
FIG. 2

CLEANING DEVICE

RELATED APPLICATIONS

The present application is a 35 U.S.C. §371 National Phase application of International Application Serial No. PCT/SE2007/000791, filed on Sep. 11, 2007, which claims priority from Swedish Patent Application No. 0602344-4, filed on Nov. 2, 2006, the disclosures of which are incorporated herein by reference in their entireties.

FIELD OF THE INVENTION

The present invention generally relates to the field of cleaning devices and more particularly to a cleaning device comprising at least one cleaning cloth provided with a care label.

BACKGROUND OF THE INVENTION

Cloths are in widespread use in different types of cleaning devices. They may be provided singly in order to wipe dirty surfaces. But they may also be provided as a part of another product like for instance as a part of a mop.

As these cloths are used they of course get dirty. In order to be able to reuse a cloth it may then be washed. Depending on the type of material provided in the cloth there has to be provided information about how the cloth is to be handled in relation to being washed. Such information is normally provided in the form of a care label that indicates if the cloth can be washed in a machine or if it has to be washed by hand, what temperature should be used when washing, if it can be tumble dried or ironed. This care label may also include a logotype associated with the product, seller or manufacturer. Such a logotype may furthermore also be provided on a separate label.

It is of interest to provide additional cleaning uses in relation to a cloth, like for instance providing one function of wet wiping and another of dry wiping. It may furthermore be of interest to provide a stain scraping function together with a cloth. This should furthermore be done without having to provide an additional cloth or without having to enlarge the cloth.

WO 2005/04452 describes a cloth that is provided with a first and a second fabric surface, where one surface has tufted fibres for one type of cleaning like removing dust and another surface has flat polyester strands or metalised polyester for providing a scrubbing function.

It is also known to use VELCRO™ for attachment to hangers of towels, see for instance U.S. Pat. Nos. 5,147,703 and 5,761,761.

The problem with the type of arrangement described in WO 2005/04452 is that in use one surface may disturb the other. Thus the use of one surface may be impeded by the other surface. Moreover, the first surface to be used may become smaller than what is desired because of the provision of the second surface on it.

There is therefore a need for an improved cleaning cloth used in or as a cleaning device.

SUMMARY OF THE INVENTION

The present invention thus relates to the provision of an improved cleaning device.

This is achieved by a cleaning device comprising:

at least one cleaning cloth of one type of material providing a wiping function, and a care label attached to an edge of the cleaning cloth, wherein the care label comprises a patch of a material having a different internal configuration than the material of the cleaning cloth and that provides a scrubbing function.

The dependent claims are directed towards advantageous variations of the invention.

The expression care label is intended to comprise a tag that is attached to a piece of washable material including information that indicates how the material is to be handled when being washed and in relation to such washing, like if it can be washed in a machine or if it has to be washed by hand, what temperature should be used when washing, if it can be tumble dried or ironed. It may also include information indicating the origin of the product like a logotype, for instance associated with the product, the seller or the manufacturer of the product.

The invention provides several advantages. There is no need to keep track of different cleaning utensils, since they are provided together. It furthermore provides more cleaning functionality without using additional space. It provides additional cleaning functionality by using a part of a cloth that is already there, namely the label. Thus the label is put to use also for cleaning. The additional cleaning ability is furthermore provided without limiting the functionality or size of the cloth. The cloth and the patch can also be used independently of each other and without impeding each other. Further advantages of the invention will become apparent by the following detailed description of a preferred embodiment of the invention.

BRIEF DESCRIPTION OF THE DRAWINGS

The present invention will now be described in more detail with reference being made to the accompanying drawings, where FIG. 1*a* shows a perspective view of a cleaning device according to a first embodiment of the present invention in the form of a cloth provided with a care label that is shown aligned with the cloth, FIG. 1*b* shows a perspective view of a cloth according to the first embodiment of the present invention where the care label has been bent upwards in relation to the cloth, FIG. 2 shows a perspective view of a cloth according to a second embodiment of the present invention provided with a care label with a patch that can be removably attached to the care label.

DETAILED DESCRIPTION OF EMBODIMENTS OF THE INVENTION

Figure 3:
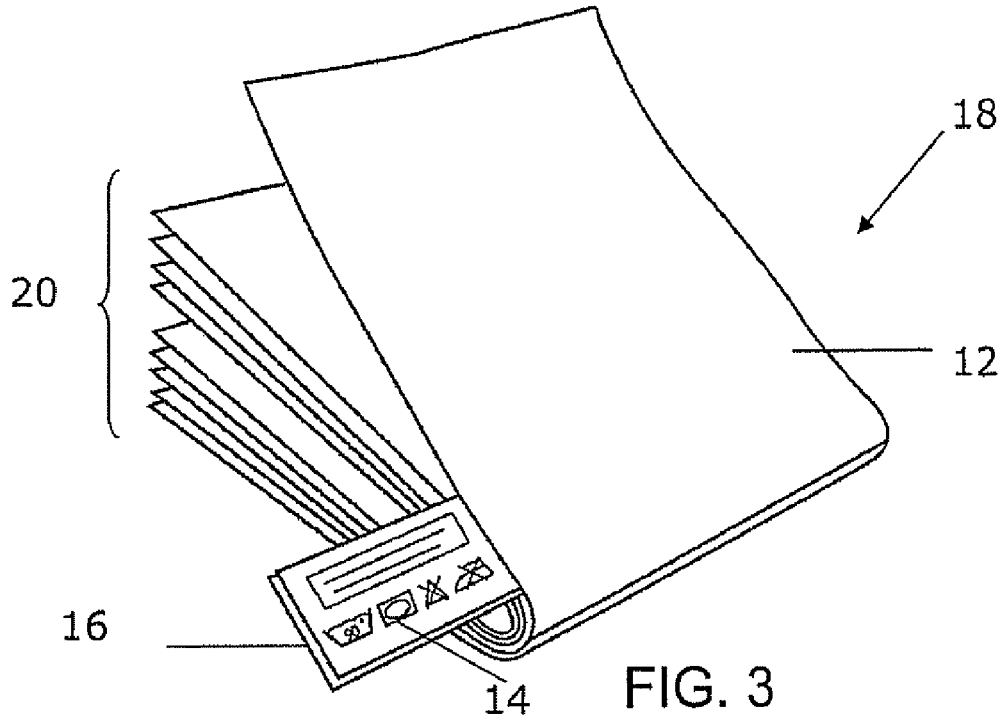
FIG. 3 shows a perspective view of a cleaning device according to a third embodiment of the present invention in the form of a number of cloths that have been joined together in the form of a book.

FIGS. 1*a* and *b* show perspective views of a cleaning device 10 according to a first embodiment of the present invention. The cleaning device 10 is here provided as a cloth 12 of washable textile material. The material is here of a type that provides a cleaning function, which is a wiping function. The cloth 12 is according to this embodiment provided in the form of a micro fibre material having a certain internal configuration, i.e. the fibres may have a certain size, shape, orientation. It may also have a certain blend of fibres. As mentioned earlier the cloth 12 is washable. It is therefore provided with a care label 14 that is fastened to one edge or side of the cloth and thus extends from this side in a direction away from the side, which is with advantage away from the cloth 12. The care label 14 may be rotatably connected to the side of the cloth 12, which means that the care label 14 may be turned upward or downward in relation to the cloth 12. The care label 14 includes care information that indicates how the cloth 12 should be treated in relation to washing, like if the cloth 12 can be washed in a machine or if it has to be washed by hand, what temperature should be used when washing, if it can be tumble dried or ironed etc. It may also include information about the origin of the cloth, like a logotype for instance associated with the cloth itself, the seller or the manufacturer of the cloth. The care label 14 may be of any suitable material, like for instance cotton. It may also be of the same material as the cloth, i.e. be a form of micro fibre material. According to the present invention the care label also comprises a patch 16. Thus there is also a patch 16 combined with this care label 14. The patch 16 is here wholly contained within an area that is bounded by the perimeter of the care label 14, i.e. it does not stretch beyond this area. Thus the area occupied by the patch is contained within this area of the label 14. It may however influence the thickness of the care label 14. The patch 16 is of a material that has another internal configuration than the cloth. This means that it may be a micro fibre material of the same type as the cloth 12 but having different size and/or shape and/or orientation of the fibres or it may be another type of micro fibre material or a completely different material. In both these latter cases the whole internal configuration of the patch material thus differs from the internal configuration of the cloth material. It can also differ through only having an abrasive agent added. By providing such a patch 16 a different cleaning function is provided. The patch 16 thus provides a different type of cleaning function than the cloth 12 provides. According to the present invention the patch 16 is of a material that provides a scrubbing function. According to the first embodiment the patch 16 is fixedly attached to the care label 14, for instance through stitching. It is furthermore possible that the care label 14 is of the same material as the patch 16, i.e. that the patch also functions as a care label and that they are in essence the same unit. The care label 14 and the patch 16 may thus be provided as separate pieces of material as well as provided as one unitary piece of material. The patch 16 may thus be integral with the care label 14.

As can be seen in FIGS. 1*a* and 1*b*, the care label 14 with the patch 16 can be turned in relation to the side of the cloth 12. This means that the cloth 12 can be used for its intended cleaning function, like for instance to wipe a surface, like a table surface, a sink surface, a floor etc., without the patch 16 impeding this cleaning. When the cleaning function provided by the patch 16 is desired, it is easily turned to face the surface. It may then be pressed onto the surface for performing the associated cleaning function. If no pressure is applied to the cloth 12, the cloth will not impede the cleaning provided by the patch 16. In this way it is for instance possible to wet wipe a surface with the cloth and then use the patch to scrub away stains.

There are several advantages associated with this cleaning device 10. There is no need to keep track of different cleaning utensils, since they are provided together. It furthermore provides more cleaning functionality without using additional space. It provides additional to cleaning functionality by using a part of the device 10 that is already there, namely the care label 14. Thus the care label 14 is put to use also for cleaning. The additional cleaning ability is furthermore provided without limiting the functionality or size of the cloth 12.

FIG. 2 shows a perspective view of a cloth according to a second embodiment of the present invention. The device 10 is here basically the same as in the first embodiment with a cloth 12, a care label 14 and a patch 16. However, here the patch 16 can be attached to, removed from and reattached to the care label 14. The patch 16 may thus be removably attached to the care label 14. This functionality can be provided through providing the patch and the care label with suitable attachment means, like for instance VELCRO™.

This embodiment has a number of further advantages. It allows the patch 16 to be taken away and replaced. This can be the case if for instance the patch 16 is worn out and has to be replaced. It also opens up for the possibility to have several different patches 16 providing different cleaning functions. In this way a user may select the additional type of cleaning function that is desired in addition to the one provided by the cloth 12 and select a patch 16 that is best suited for this cleaning function. Another advantage is that this enables the provision of patches 16 that are not supposed to be handled in the same way as the cloth 12, like should not be washed at all or should be washed in a different way. It is then a simple matter for a user to remove the patch before the rest of the cleaning device is handled according to the care label 16.

FIG. 3 shows a perspective view of a cleaning device 18 according to a third embodiment of the present invention in the form of a number of cloths 12, 20 that have been joined together in the form of a book. Here one of the cloths 12 is provided with a care label 14 having a patch 16, where the patch 16 may either be fixedly attached or removably attached, while the rest of the cloths 20 lack such a patch and care label. By joining several cloths in this way it is easy to keep them together and they are easier to locate. It is also possible that the cloths are of different types and/or of different internal configurations. In this way it is possible to provide several different types of cleaning functions by the same device. This allows a quick change between different types of cleaning. If wet wiping is to be performed it is furthermore a simple task to take the whole book and wring it in order to remove water. In this way water can be removed from all cloths simultaneously.

The cleaning device of the present invention is not limited to only be used in a single or a group of cloths as in the previous embodiments. The cleaning device may also be another device like a mop, a mop refill device or a window scraping device.

Figure 4:
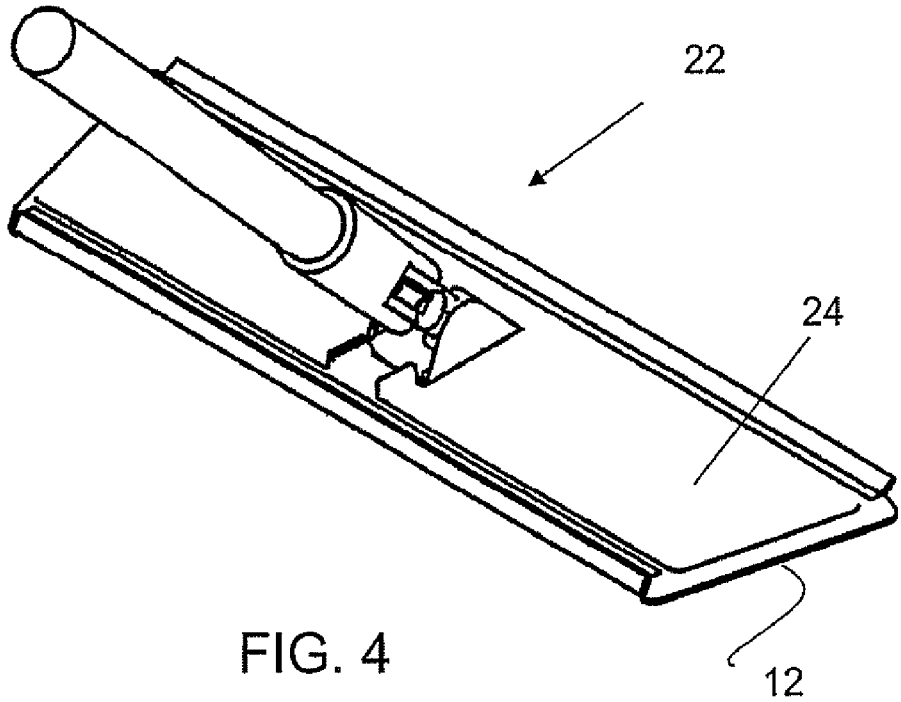
FIG. 4 shows a perspective view of a cleaning device according to a fourth embodiment of the present invention in the form of a mop on which a cloth is fastened.

FIG. 4 shows a perspective view of a cleaning device according to a fourth embodiment of the present invention in the form of a mop 22. The mop includes a mop assembly 24 and a shaft. The assembly 24 has an upper side as well as a bottom side. At the bottom side of the mop assembly 22 there are provided fasteners, for instance made of Velcro™, in order to fasten a cleaning cloth 12 provided with a care label and a patch (not shown). This cloth 12 may furthermore also be removed and washed. The cloth 12 provides normal well-known wiping functionality, which will therefore not be described in any detail here. However, when the patch is desired to be used, a user may put his foot on the patch, press it and while at the same time moving the foot back and forth. The user does not have to bend down for performing the cleaning function of the patch, which means that the back of the user is spared. If the patch is a scrubber it is in this way easy to remove stains from a floor.

The cleaning device according to all the embodiments of the present invention is a household cleaning device. However, it is possible that the cleaning device may be used in other fields, like in industry.

The patch was above described as being placed on a care label. As an alternative or in addition to being placed there, a patch may be placed on another type of product information label, for instance on separate type of label indicating the origin of the product, like a logotype label fastened in the same way as a care label to a side of the cloth.

The cloth was above described as being a micro fibre cloth. However it is not limited to this. The cloth may be woven or non-woven. It may be a fabric, a textile, hydrophilic material, felt, fleece, cotton, linen, chamois, wool, silk, lycra, spandex, rayon, velvet, silicon, polyolefin, polyurethane, acrylics, rubber-resin and polyamides. Examples of hydrophilic fibres are rayon, cotton, wood pulp, flax and ramie.

Fibre yarns of the cloth may be natural, like wool or cotton, or synthetic fibre yarns, like nylon, polyester, acrylic, polyamide or polypropylene as well as combinations of different types of yarns. They may also be staple or continuous filament yarns. The fibres can either be single or 2- or 3 or 4-ply.

The product information label may be of any of the above mentioned materials.

The patch may also be of any of the above mentioned materials. It may be of a non-woven material and then including fibres of polyamide and polyester with vinylacrylic and ureic resin and may also comprise an abrasive agent, for instance a mineral. It should however be realised that it can be provided without mineral. As an alternative it is possible to consider providing the patch through co-extruding of polypropylene and a thermoplastic such as SEBS, where this thermoplastic is filled with mineral in order to provide a scrubbing function. In addition to this it may also be of a non-woven material that comprises an abrasive agent. It may also be LUREX®, metalplastic yarns, polyamide, SCOTCH-BRITE®, polypropylene, nylon, plastic, abrasive fibers, acrylic fiber and threads. Finally it may also be of a rubber like caoutchouc.

It should here be realised that both the cloth and the patch may be of different materials depending on the type of surfaces that are to be cleaned. A cloth of any of the above mentioned cloth materials may furthermore be combined with a patch of any of the above mentioned patch materials, with or without abrasive agent.

Therefore the present invention is only to be limited by the following claims.

The invention claimed is:

1. A cleaning device comprising:

at least one cleaning cloth of one type of material providing a wiping function, and a care label rotatably attached to an edge of the cleaning cloth, the care label comprising a first care information side having care information thereon including information regarding how to wash the at least one cleaning cloth, and a second side that is opposite the first care information side, the care label further comprising opposite first and second ends, wherein the first and second sides are between the opposite first and second ends, the first end is connected to the edge of the cleaning cloth and the second end is a free end, and the care label is movable between a first position in which the free second end overlays the cleaning cloth and a second position in which the free second end rotates away from the cleaning cloth;

wherein said care label comprises a patch on the second side of the care label opposite the first care information side of the care label, the patch comprising a material of a type having a different internal configuration than the material of the cleaning cloth and that provides a scrubbing function;

wherein the label and the patch are provided as separate pieces of material, the patch is fixedly attached to the label and the first end of the care label is directly connected to the edge of the cleaning cloth and the second end of the care label is a free end.

2. A cleaning device according to claim 1, wherein the cloth is of a micro fibre material.

3. A cleaning device according to claim 1, wherein the patch is a different type of material than the cleaning cloth.

4. A cleaning device according to claim 1, wherein the device is a mop having a mop assembly, and the cloth is attached to a bottom side of the mop assembly.

5. A cleaning device comprising:

a plurality of cleaning cloths bound together as a book;

at least one cleaning cloth of the plurality of cleaning cloths of one type of material providing a wiping function, and a care label rotatably attached to an edge of the at least one cleaning cloth such that said care label is configured to be turned with respect to the edge of the at least one cleaning cloth, wherein said care label comprises a patch of a material of a type having a different internal configuration than the material of the at least one cleaning cloth cleaning cloth and that provides a scrubbing function.

6. A cleaning device according to claim 5, wherein the plurality of cleaning cloths have materials with different internal configuration in order to provide different grades of cleaning performance.

7. A cleaning device comprising:

at least one cleaning cloth of one type of material providing a wiping function, and a care label rotatably attached to an edge of the cleaning cloth, the care label comprising a first care information side having care information thereon including information regarding how to wash the at least one cleaning cloth, and a- second side that is opposite the first care information side, the care label further comprising opposite first and second ends, wherein the first and second sides are between the opposite first and second ends, the first end is connected to the edge of the cleaning cloth and the second end is a free end, and the care label is movable between a first position in which the free second end overlays the cleaning cloth and a second position in which the free second end rotates away from the cleaning cloth;

wherein said care label comprises a patch on the second side of the care label opposite the first care information side of the care label, the patch comprising a material of a type having a different internal configuration than the material of the cleaning cloth and that provides a scrubbing function;

wherein the patch is wholly contained within an area that is bounded by a perimeter of the care label.

8. A cleaning device according to claim 7, wherein the cloth is of a micro fibre material.

9. A cleaning device according to claim 7, wherein the patch is a different type of material than the cleaning cloth.

10. A cleaning device according to claim 7 wherein the label and the patch are provided as separate pieces of material.

11. A cleaning device according to claim 10, wherein the patch is fixedly attached to the label.

12. A cleaning device according to claim 10, wherein the patch is removably attached to the label with hook and loop material.

* * * * *

UNITED STATES PATENT AND TRADEMARK OFFICE

CERTIFICATE OF CORRECTION

PATENT NO. : 8,205,288 B2
APPLICATION NO. : 12/093640
DATED : June 26, 2012
INVENTOR(S) : Broman et al.

It is certified that error appears in the above-identified patent and that said Letters Patent is hereby corrected as shown below:

In the Claims:

Column 6, Claim 5, Line 22: Please correct "one cleaning cloth cleaning cloth"
to read -- one cleaning cloth --

Claim 7, Line 35: Please correct "cloth, and a- second side"
to read -- cloth, and a second side --

Signed and Sealed this
Ninth Day of April, 2013

Teresa Stanek Rea

Teresa Stanek Rea
*Acting Director of the United States Patent and Trademark Office*